US007308955B2

(12) United States Patent
Barton et al.

(10) Patent No.: US 7,308,955 B2
(45) Date of Patent: Dec. 18, 2007

(54) STABILIZER ARRANGEMENT

(75) Inventors: Steven Paul Barton, Katy, TX (US); Andrew David Murdock, Houston, TX (US); Graham Richard Watson, Gloucester (GB)

(73) Assignee: ReedHycalog UK Limited (GB)

( * ) Notice: Subject to any disclaimer, the term of this patent is extended or adjusted under 35 U.S.C. 154(b) by 158 days.

(21) Appl. No.: 11/276,978

(22) Filed: Mar. 20, 2006

(65) Prior Publication Data

US 2006/0213691 A1 Sep. 28, 2006

(30) Foreign Application Priority Data

Mar. 22, 2005 (GB) ..... 0505719.5
Mar. 22, 2005 (GB) ..... 0505912.6

(51) Int. Cl.
*E21B 17/10* (2006.01)

(52) U.S. Cl. ..... 175/325.5; 166/241.6

(58) Field of Classification Search .. 175/325.1–325.5; 166/241.6, 241.7
See application file for complete search history.

(56) References Cited

U.S. PATENT DOCUMENTS 4,071,101 A * 1/1978 Ford ..... 175/325.3
4,378,852 A * 4/1983 Garrett ..... 175/325.4
4,662,461 A * 5/1987 Garrett ..... 175/325.4
5,318,137 A * 6/1994 Johnson et al. ..... 175/40

* cited by examiner

*Primary Examiner*—Frank Tsay
(74) *Attorney, Agent, or Firm*—Jeffrey E. Daly

(57) ABSTRACT

A stabilizer comprises a body having first and second ends, each of which is formed with a respective connector means, the body having an outer wall upon which is formed a plurality of the upstanding blades radially outer surfaces of which define gauge pads, flow channels being defined between adjacent ones of the blades, and at least one bridging region interconnecting two adjacent ones of the blades to form an enclosed passage communicating with an associated one of the flow channels, the bridging region having a surface defining part of an outer gauge surface of the stabilizer, the at least one bridging region being located intermediate and spaced from the first and second ends.

16 Claims, 4 Drawing Sheets

Fig. 8
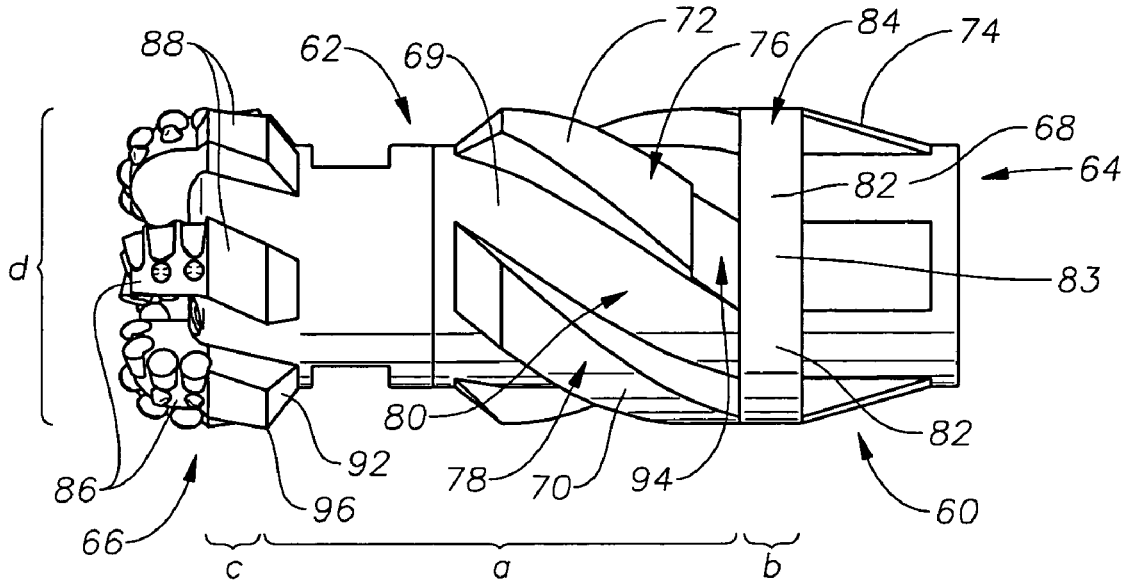
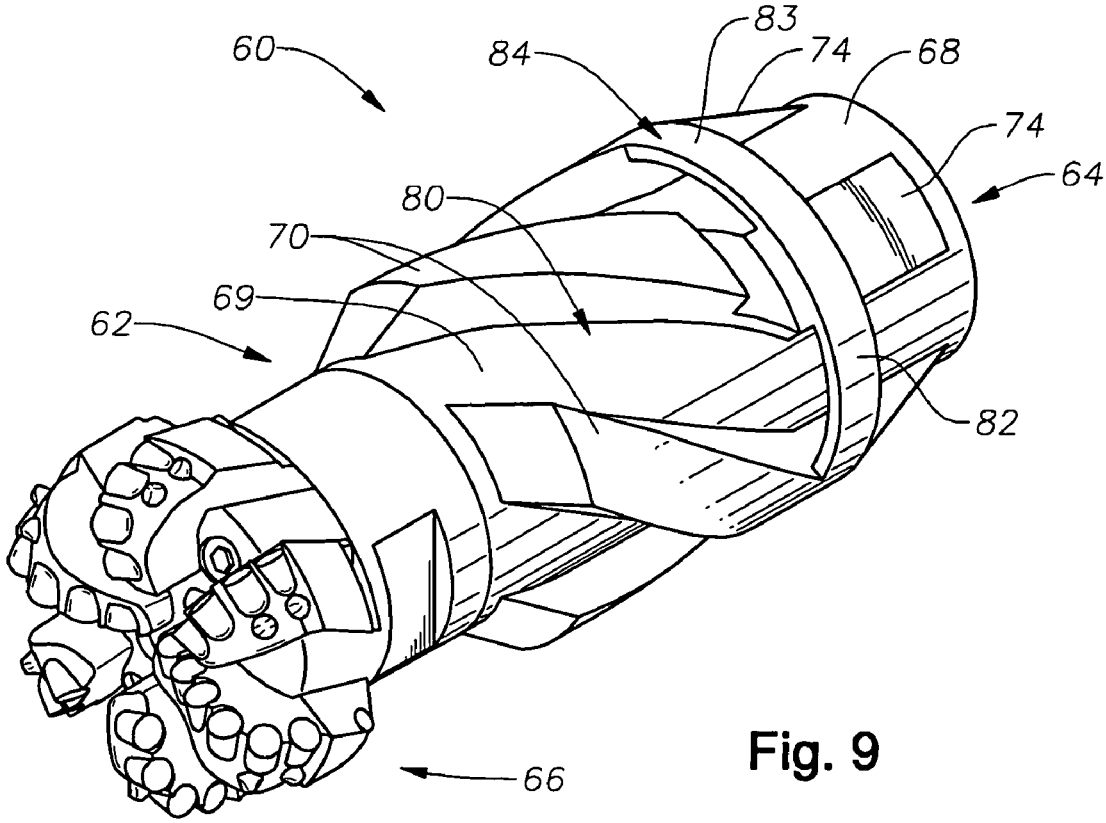
Fig. 9

STABILIZER ARRANGEMENT

BACKGROUND OF THE INVENTION

This invention relates to a stabilizer arrangement for use in downhole drilling applications.

Subterranean boreholes commonly extend underground for great distances and are often formed using steerable drilling systems with the result that the direction thereof may change significantly over the length of the borehole. The loadings experienced by the drill string used in the formation of such a borehole, during rotation thereof, are large and in order to reduce drag, and allow cuttings from the formation to pass up the borehole to the surface, the drill string is typically smaller in diameter than the borehole so as to provide some annular clearance around the drill string and allow contact between the dill string and the borehole wall to be kept to a minimum. Stabilizers are used at intervals along the length of the drill string in order to stabilise the drill string relative to the borehole. Stabilizers are also commonly used, for similar purposes, in the bottom hole assembly including adjacent to the drill bit.

Stabilizers are described in, for example, U.S. Pat. No. 1,721,004, U.S. Pat. No. 3,945,446 and U.S. Pat. No. 4,456,080 in which in addition to providing a gauge surface which, in use, bears against the wall of the borehole in which the stabilizer is used, also define flow passages to allow fluids to continue to flow along the borehole.

SUMMARY OF THE INVENTION

The present invention provides a stabilizer suitable for use in such applications as described above and which is of simple and convenient form.

According to the present invention there is provided a stabilizer comprising a body having first and second ends, each of which is formed with a respective connector means, the body having an outer wall upon which is formed a plurality of upstanding blades, radially outer surfaces of which define gauge pads, flow channels being defined between adjacent ones of the blades, and at least one bridging region interconnecting two adjacent ones of the blades to form an enclosed passage communicating with an associated one of the flow channels, the bridging region having a surface defining part of an outer gauge surface of the stabilizer, the at least one bridging region being located intermediate and spaced from the first and second ends.

A plurality of such bridging regions may be provided. Some of the bridging regions may be aligned with one another in the axial direction of the stabilizer. Some of the bridging regions may be spaced apart from one another in the axial direction of the stabilizer.

The bridging regions may, together, define a gauge surface which extends around substantially the full circumference of the body. Alternatively, the gauge surface may extend around only part of the circumference of the body.

The body may be formed of two or more components which are attached or attachable to one another.

Cutting elements may be provided on the blades and/or bridging region(s), if desired.

The blades may extend in a direction parallel to the axis of the body. Alternatively, the blades could be of spiral-like form.

The blades may be of generally uniform height along their length. Alternatively they may be of varying height, for example they may be curved, tapered or include stepped regions. Each blade may be broken into several parts in the axial direction of the stabilizer.

The invention also relates to a stabilizer arrangement comprising a stabilizer as described hereinbefore in combination with a drill bit, the drill bit having a gauge region, a shoulder being defined at an edge of the gauge region remote from a leading face of the drill bit, wherein a sum of a distance between the bridging region and the shoulder, a thickness of the bridging region and a width of the gauge region of the bit is less than 1.5 times a diameter of the drill bit.

BRIEF DESCRIPTION OF THE DRAWINGS

The invention will further be described, by way of example, with reference to the accompanying drawings, in which:

FIGS. 8 and 9 illustrate a stabilizer in accordance with another embodiment of the invention located adjacent a drill bit.

DETAILED DESCRIPTION

Figure 1:
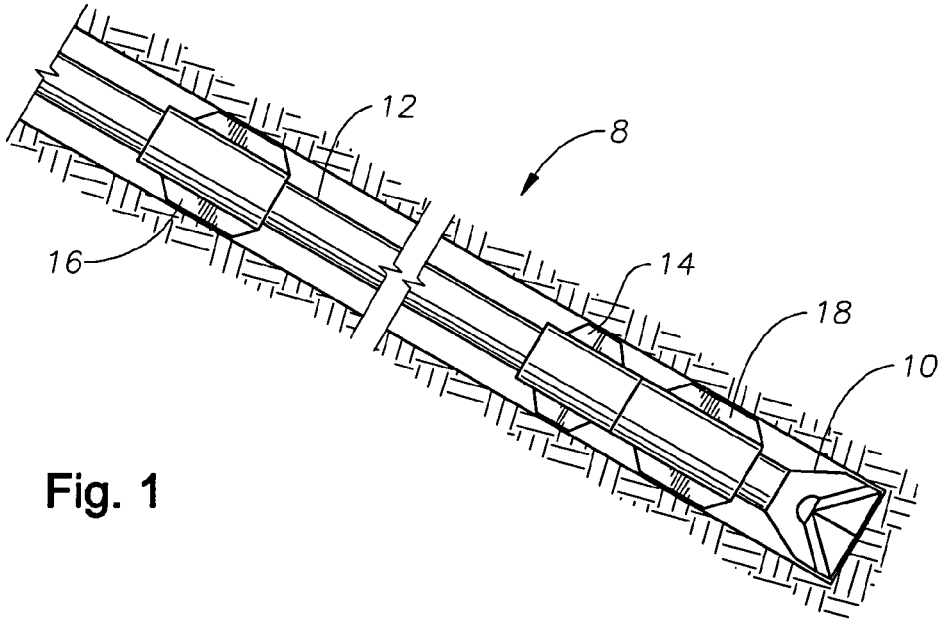
FIG. 1 is a diagrammatic view illustrating part of a downhole drilling arrangement including a preferred embodiment of a stabilizer in accordance with the invention.

Referring to the drawings, FIG. 1 shows, in diagrammatic form, part of a drilling system including a bottom hole assembly 8 comprising a drill bit 10 arranged to be driven for rotation, for example by a downhole, fluid driven motor or from the surface. A bias unit 14 is provided to allow the application of a sideways acting load to the bit 10 under the control of a control arrangement for use in controlling the drilling direction. A stabilizer 18 is provided to hold the adjacent part of the bottom hole assembly centrally within the borehole. As illustrated, the stabilizer 18 may be located immediately adjacent the bit 10. However, it could be spaced therefrom. In use, drilling fluid is supplied to the bottom hole assembly through the drill string, and returns to the surface through the annulus between the drill string and the borehole wall, carrying with it cuttings, etc., from the borehole.

It will be appreciated that the other set-ups are possible in which, for example, no bias unit and/or no motor is provided.

The bottom hole assembly is carried by a drill string 12 and additional stabilizers 16 are provided, at intervals, along the drill string to stabilise the adjacent parts of the drill string within the borehole. The additional stabilizers 16 may be of the same form as the stabilizer 18.

In use, a weight-on-bit load is applied to the drill bit 10 and the bit is rotated with the result that the bit 10 shears, scrapes, gouges or abrades formation material, thereby increasing the length of the borehole. The drilling fluid is used to clean and cool the bit and carry away the formation material removed by the operation of the bit.

Figure 2:
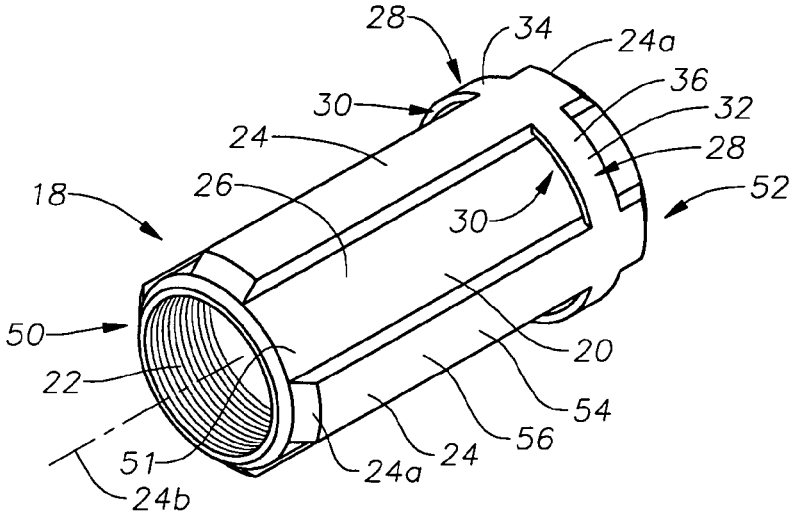
FIG. 2 is a diagrammatic perspective view of the stabilizer included in the arrangement of FIG. 1.

As shown in FIG. 2, the stabilizer 18 comprises a generally cylindrical body 20, first and second ends 50, 52 of which are provided with connectors, for example in the form of tapering, screw-threaded recesses 22 arranged to mate with correspondingly shaped projections provided on adjacent components of the drill string or bottom hole assembly to form box-pin type connections therebetween. It will be appreciated that non-tapering arrangements are possible, and also that, if desired, the connection could comprise screw threaded projections.

The outer wall 51 of the body 20 is provided with a plurality, in this case four, of upstanding blades 24. Each blade 24 is of substantially uniform height along its length, other than at its ends 24*a* where it curves or tapers to the diameter of the body 20. The blades 24 all extend, in this embodiment, in a direction generally parallel to the axis 24*b* of the body 20. The blades 24 are substantially equally spaced around the body 20 and each pair of adjacent blades 24 defines therebetween a flow channel or junk slot 26 allowing drilling fluid or mud to flow past the stabilizer 18 and carry with it matter cut from the formation by the bit 10. Each blade 24 has a radially outer surface 54 defining a gauge pad 56 which, in use, bears against the formation in which the borehole is being formed.

As shown in FIG. 2, close to one end of the stabilizer 18, a series of bridging regions 28 are provided, each bridging region 28 interconnecting a pair of adjacent ones of the blades 24, bridging the flow channel 26 therebetween so as to form an enclosed passage 30 communicating with the associated flow channel 26, passage 30 extending beneath the bridging region 28. The exposed surface 32 of each bridging region 28 is of part-cylindrical form and forms part of an outer gauge surface 34 of the stabilizer 18.

In the arrangement of FIG. 2, bridging regions 28 are associated with all of the flow channels 26, the bridging regions 28 all being located at the same point along the axis of the stabilizer, close to one end of the stabilizer, and so together form a gauge ring 36 located close to that end of the stabilizer. As a result, the gauge surface 34 extends around the full circumference of the stabilizer 18 and is of substantially cylindrical shape. The provision of such a gauge ring 36 enhances stability compared to, for example, arrangements in which bridging regions interconnecting blades are not provided, while still allowing drilling fluid to flow along the flow channels.

Although FIG. 2 illustrates the bridging regions 28 located only at end of the stabilizer 18 to form a gauge ring 36 at that end of the stabilizer, the location of the gauge ring may be changed to suit the intended application, thus the gauge ring could be formed at, for example, a more central position or close to the other end of the unit. Further one or more additional sets of bridging regions may be provided to form additional gauge rings at other axial positions, if desired.

Figure 3:
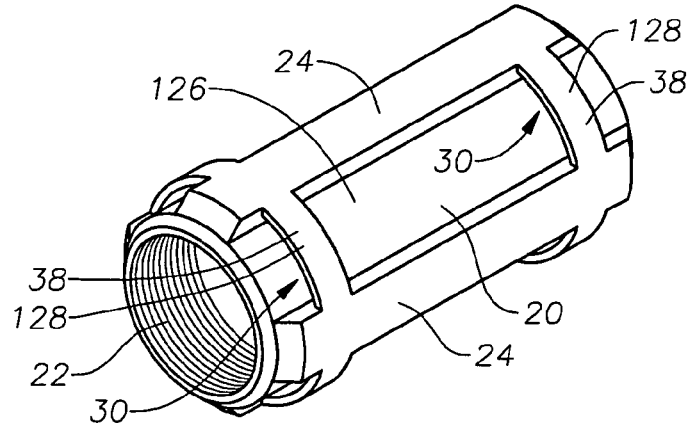
FIG. 3 is a view similar to FIG. 2 illustrating an alternative preferred embodiment of the invention.
Figure 3B:
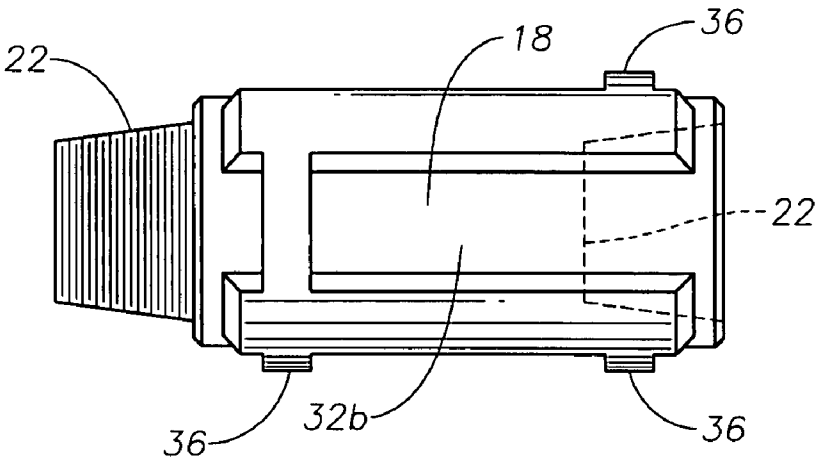
FIGS. 3*a*, 3*b* and 3*c* illustrate some variants forming further preferred embodiments of the invention.
Figure 3A:
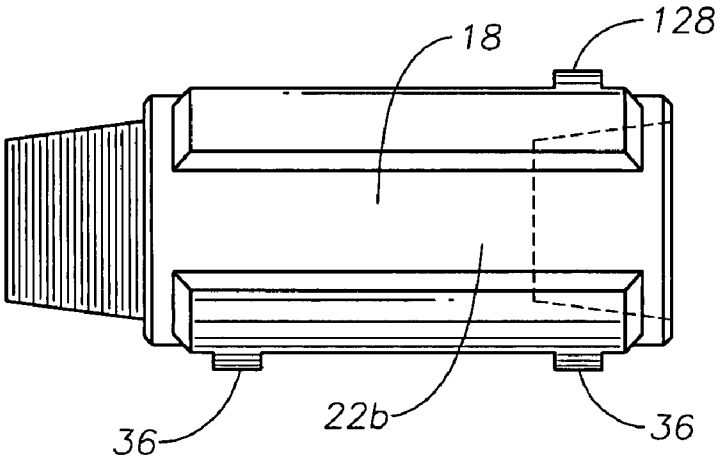
Figure 3C:
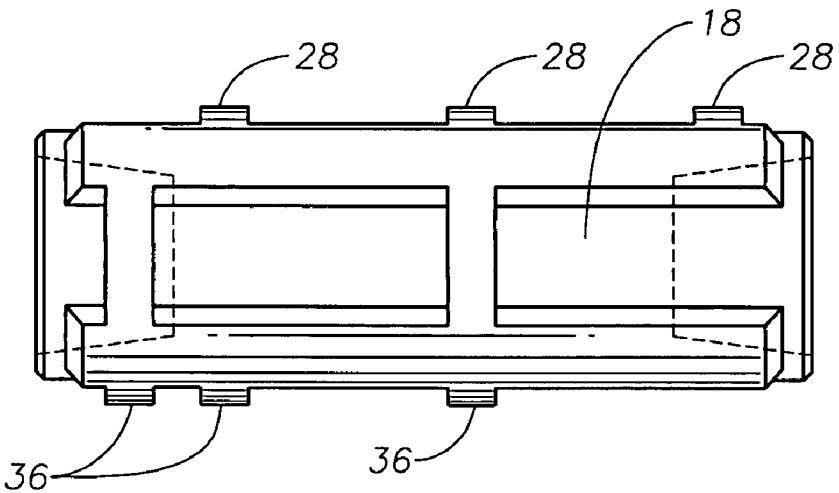

FIG. 3 illustrates an arrangement in which the bridging regions 128 thereof do not form a continuous gauge ring at one axial position of the stabilizer, but rather bridging regions 128 are provided at two or more different axial positions along the length of the stabilizer. As a result, two or more partial rings 38 are formed. The partial rings 38 may be oriented so as to form a stepped gauge ring extending around the full circumference of the body but at different axial positions. However this may not always be the case and arrangements are contemplated in which one or more flow channels 226 may have no bridging region associated therewith (see FIG. 3*a*). Further, one or more of the flow channels 326 may have more than one bridging region associated therewith (see FIG. 3*b*). The axial location of the rings or partial rings need not be as shown, and FIG. 3*c* illustrates some possible locations, but it will be appreciated that this is not exhaustive.

Figure 4:
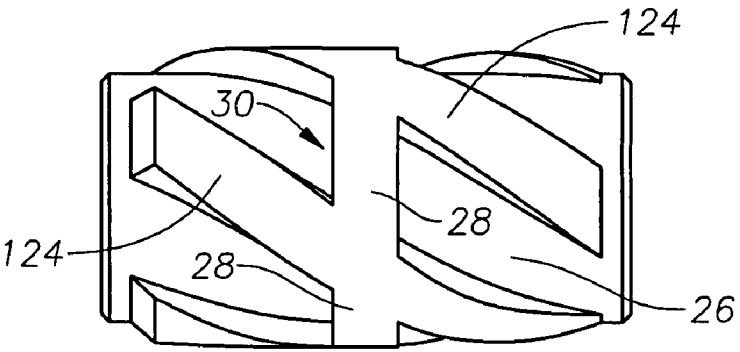
FIGS. 4 and 5 are views illustrating a further embodiment of the invention.
Figure 5:
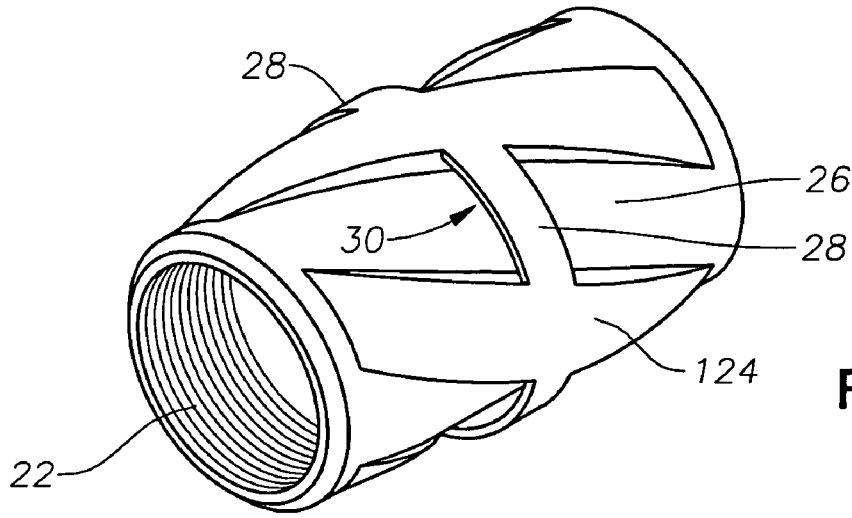

FIGS. 4 and 5 illustrate an arrangement in which the blades 124, instead of extending parallel to the axis of the stabilizer, are of generally spiral form. Further, the blades 124 are of non-uniform, tapering height. By providing tapering blades in this manner, the overall amount and length of contact with the wall of the borehole is reduced which may be advantageous in, for example, steerable systems. Further, the stagnant regions which otherwise occur at the ends of the blades are eliminated, fluid being able to wash over the parts of the blades.

Figure 6:
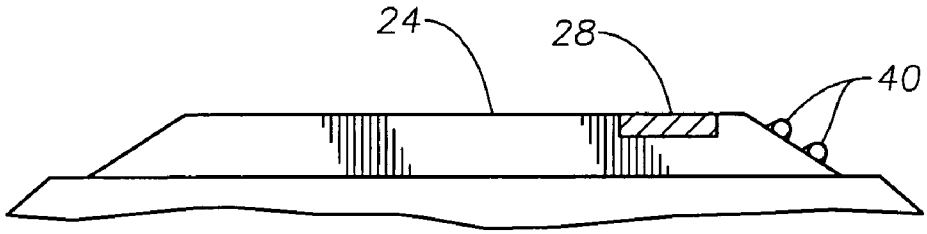
FIGS. 6 and 7 are views illustrating some possible modifications forming further embodiments of the invention.

In the arrangements described and illustrated hereinbefore, the blades and bridging regions are free of cutting elements and are not intended to perform a cutting function. However, this need not always be the case and, as illustrated in FIG. 6, one or more cutters 40 may be provided on the blades and/or bridging regions. By way of example, where a taper is formed at the ends of the blades, cutters 40 may be located on the taper to perform, for example, an under reaming or up reaming function. Cutters could, however, be located elsewhere on the blades and/or bridging regions.

Figure 7:
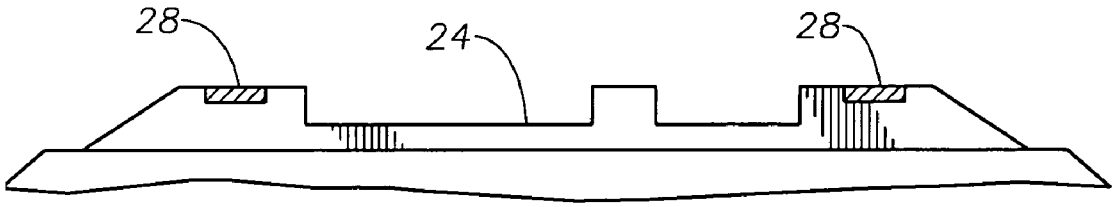

FIG. 7 illustrates another modification in which the blades 24 are of non-uniform blade height. In the arrangement illustrated, the bridging regions 28 form a pair of gauge rings 36 and, between the gauge rings 36, the blades 24 are of reduced blade height. Depending upon the desired fluid flow properties of the stabilizer, the blades 24 may include regions of zero blade height, thus being broken into two or more blade sections.

As mentioned hereinbefore, the stabilizer 18 may be located immediately adjacent a drill bit 10, for example as shown in FIGS. 8 and 9. In this embodiment the stabilizer unit 60 is formed at its ends 62, 64 with threaded female or box connections (not shown in FIGS. 8 and 9), one of which is arranged to mate with a threaded male or pin connection of the drill bit 66. The other box connection is intended to be secured to another component of the bottom hole assembly or drill string. The stabilizer 60 comprises a body 68 having an outer wall 69 on which a plurality of blades 70 are formed. Each blade 70 is shaped to include a spiral-shaped region 72 at the end of the stabilizer 60 closest to the bit 66, and a region 74 extending parallel to an axis of the stabilizer 60. The spiral-shaped regions 72 are of substantially uniform blade height and have radially outer surfaces 76 which define gauge pads 78 arranged to bear, in use, against the wall of the borehole being formed. The regions 74 are of tapering blade height.

Between adjacent ones of the blades 70 are formed flow channels 80 along which drill fluid is able to pass. Bridging regions 82 interconnect adjacent ones of the blades 70, the bridging regions 82 together forming an outer gauge surface 83 in the form of a cylindrical gauge ring 84 located between and spaced from the first and second ends 62, 64. As is common in stabilizers, the stabilizer is of dimensions slightly less than the gauge diameter of the associated bit. Thus, with a 12¼" bit, the diameter of the gauge ring 84 is approximately 12$^{3}/_{16}$", and with an 8½" bit, the diameter of the gauge ring 84 is approximately 8$^{15}/_{32}$". The location of the gauge ring 84 is such that it lies at the intersections of the spiral-shaped regions 72 with the respective regions 74. As best seen in FIG. 9, the bridging regions 82 are spaced from the body 68 and so do not break or close the flow channels 80.

The bit 66 includes a series of blades 86 each of which terminates at a respective gauge pad 88. Each gauge pad 88 terminates at a shoulder 90 at which the gauge pad 88 joins a tapering region 92. It is thought to be advantageous if a sum of a separation a of the shoulder 90 from the gauge ring 84, a thickness b of the gauge ring 84, and a width c of the gauge pad 88 is approximately equal to or less than 1.5 times a diameter d of the bit.

In order to assist assembly and dismantling operations, the unit 60 is shaped to include breaker slots 94 into which suitable tools can be inserted to hold the unit 60 against rotation. It should be noted, in this arrangement, that the blades 70 of the stabilizer 60 are axially spaced from the ends of the blades 86 of the bit 66. Such spacing allows a greater degree of flexibility without impacting severely upon the fluid flow characteristics of the assembly. For example, the bit 66 and the stabilizer 60 do not need to have the same number of blades.

The gauge pads 78 and gauge ring 84 of the stabilizer are illustrated in their unfinished form, being shown relieved to accommodate a suitable hardfacing material to improve the wear resistance of these parts of the stabilizer.

The blades provided in the stabilizer, although illustrated as being of uniform blade width, could be of varying blade width to allow, for example, the flow area to be increased. For example, the arrangement of FIGS. 8 and 9 could be modified such that the regions 74 could be of reduced blade width compared to the regions 72. Further, it may be advantageous to reduce the blade width beneath the gauge ring 84 so as to maximise the flow area in that location.

Figure 10:
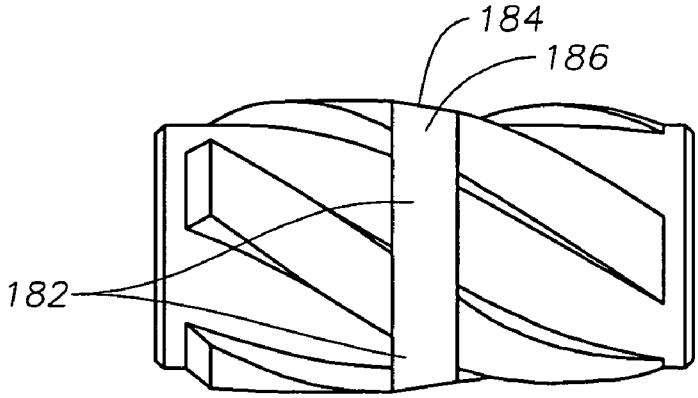
FIG. 10 is a diagrammatic view illustrating a further embodiment of the invention.

Another possibility is to modify the profile of the bridging regions. An arrangement is shown, diagrammatically, in FIG. 10 in which the profile of the bridging regions 182 is shaped such that they serve to define a gauge ring 184 having an outer gauge surface 186 of, for example, tapering form rather than of cylindrical form.

It will be appreciated that a wide range of other modifications and alterations are possible within the scope of the invention.

The invention claimed is:

1. A stabilizer comprising a body having first and second ends, each of which is formed with respective connectors, the body having an outer wall upon which is formed a plurality of upstanding blades having radially outer surfaces which define gauge pads, flow channels being defined between adjacent ones of the blades, and at least one bridging region interconnecting two adjacent ones of the blades to form an enclosed passage communicating with an associated one of the flow channels, the bridging region having a surface defining part of an outer gauge surface of the stabilizer, the at least one bridging region being located intermediate and spaced from the first and second ends.

2. A stabilizer according to claim 1, wherein a plurality of such bridging regions are provided.

3. A stabilizer according to claim 2, wherein at least some of the bridging regions are aligned with one another in the axial direction of the stabilizer.

4. A stabilizer according to claim 3, wherein bridging regions, together, define a gauge surface which extends around substantially the full circumference of the body.

5. A stabilizer according to claim 4, wherein the gauge surface which extends around substantially the full circumference of the body is a gauge ring and at least one of the blades has a varying blade width which is reduced where the blade joins the gauge ring.

6. A stabilizer according to claim 3, wherein the bridging regions together define a gauge surface which extends around only part of the circumference of the body.

7. A stabilizer according to claim 1, wherein the blades extend in a direction parallel to the axis of the body.

8. A stabilizer according to claim 1, wherein the blades are of spiral-like form.

9. A stabilizer according to claim 1, wherein each blade includes a region of spiral-like form and a region which extends in a direction parallel to the axis of the body.

10. A stabilizer according to claim 1, wherein the outer gauge surface defined, in part, by the bridging region is of substantially cylindrical form.

11. A stabilizer according to claim 1, wherein the outer gauge surface defined, in part, by the bridging region is of tapering form.

12. A stabilizer arrangement comprising a stabilizer unit connected to a drill bit, the stabilizer unit comprising a body having first and second ends, each of which is formed with respective connectors, the body having an outer wall upon which is formed a plurality of the upstanding blades radially outer surfaces of which define gauge pads, flow channels being defined between adjacent ones of the blades, and at least one bridging region interconnecting two adjacent ones of the blades to form an enclosed passage communicating with an associated one of the flow channels, the bridging region having a surface defining part of an outer gauge surface of the stabilizer, the at least one bridging region being located intermediate and spaced from the first and second ends.

13. A stabilizer arrangement according to claim 12, wherein a plurality of such bridging regions are provided, the bridging regions being axially aligned and together forming a gauge surface.

14. A stabilizer arrangement according to claim 13, wherein the drill bit includes a gauge pad terminating at a shoulder, and wherein a sum of a separation of the gauge surface from the shoulder, a thickness of the gauge surface and a width of the gauge pad is approximately equal to or less than 1.5 times a diameter of the drill bit.

15. A stabilizer arrangement according to claim 13, wherein the gauge surface is of tapering form.

16. A stabilizer arrangement according to claim 13, wherein the gauge surface is a gauge ring and at least one of the blades has a varying blade width which is reduced where the blade joins the gauge ring.

* * * * *